US005190480A

United States Patent [19]

Chau et al.

[11] Patent Number: 5,190,480

[45] Date of Patent: Mar. 2, 1993

[54] ALL-IN-ONE INTERCONNECTION ASSEMBLY

[75] Inventors: Danny K. Chau, San Francisco; Lee-Ming Cheng, Cupertino; Jeng-Yih Hwang, San Jose; Conrad Y. Choy, San Francisco, all of Calif.

[73] Assignee: Foxconn International, Inc., Sunnyvale, Calif.

[21] Appl. No.: 731,507

[22] Filed: Jul. 17, 1991

[51] Int. Cl.[5] ..... H01R 23/70

[52] U.S. Cl. ..... 439/637; 439/567; 439/924

[58] Field of Search ..... 439/62, 64, 79, 80, 439/60, 92, 101, 108, 567, 569-573, 636, 637, 924, 65, 404, 405

[56] References Cited

U.S. PATENT DOCUMENTS

| | | | |
|---|---|---|---|
| 3,680,032 | 7/1972 | Mosier et al. | 439/62 |
| 3,764,857 | 10/1973 | Bartlett | 439/64 |
| 4,477,142 | 10/1984 | Cooper et al. | 439/567 |
| 4,510,553 | 4/1985 | Faultersack | 439/78 |
| 4,639,066 | 1/1987 | Shimamiya et al. | 439/569 |
| 4,687,267 | 8/1987 | Header et al. | 439/64 |
| 4,943,244 | 7/1990 | Teck | 439/571 |
| 5,024,609 | 6/1991 | Piorunneck | 439/637 |
| 5,044,988 | 9/1991 | Hirayama | 439/609 |

FOREIGN PATENT DOCUMENTS

| | | | |
|---|---|---|---|
| 53-26978 | 3/1978 | Japan | 439/637 |

OTHER PUBLICATIONS

Research Disclosure, Kenneth Mason Publications Ltd, No. 28018, England, Aug. 1987.

*Primary Examiner*—Neil Abrams

*Attorney, Agent, or Firm*—Flehr, Hohbach, Test, Albritton & Herbert

[57] ABSTRACT

An electrical connector assembly (40) includes an insulative housing (44) defining a slot (46) formed in the front side of the housing (44). The insulative housing (44) also defines a first signal passages (48, 48*a*, 49, 49*a*) and second power passages (56, 56*a*) which each extend through the insulative housing (44) between the front side (55) and the rear side (57) of the housing (44). Moreover, each first and second passage (48, 48*a*, 49, 49*a*, 56, 56*a*) includes an opening (51, 51*a*, 54, 54*a*) into the slot (46). The electrical connector (40) of the present invention also includes a plurality of signal and power conductive members (50, 50*a*, 52, 52*a*, 58, 58*a*) each of which includes a respective signal and power contact portions (60, 60*a*, 64, 64*a*). The signal and power conductive members (50, 50*a*, 52, 52*a*, 58, 58*a*) are further dimensioned to be positioned in the first and second respective passages (48, 48*a*, 49, 49*a*, 56, 56*a*) such that each respective signal and power contact portions (60, 60*a*, 64, 64*a*) extend through the respective openings (51, 51*a*, 54, 54*a*). The contact portions (60, 60*a*, 64, 64*a*) protrude into the slot (46) to contact respective signal and power conductive pads (33) when the PCB edge (24) is received in the slot (46). Therefore, the electrical connector (40) provides for the peripheral signal interconnections and the power line transmission interconnections to be communicated therethrough. In another aspect of the present invention, the electrical connector (40) may be mounted directly to the computer chassis (23).

9 Claims, 7 Drawing Sheets

ALL-IN-ONE INTERCONNECTION ASSEMBLY

BACKGROUND OF THE INVENTION

1. Field of the Invention

The present invention relates to electrical interconnection assemblies and, more particularly, to electrical interconnections to printed circuit boards.

2. Description of the Related Art

A computer system generally includes: at least one printed circuit board (PCB), a computer chassis and peripherals interconnected to the PCBs. Often, a PCB includes conductive pads disposed along an edge of the PCB. When that board-edge of the PCB is inserted into a board-edge connector, the conductive pads resiliently engage corresponding contacts of the board-edge connector.

Often, a board-edge connector is used to electrically interconnect components on a PCB to peripherals such as an analog board for a video display, a hard disk drive or a floppy disk drive. Alternatively, "headers" directly upstanding from the PCB face often are used to interconnect components on a PCB to such peripherals.

In some cases, multiple headers and board-edge connectors are used to interconnect a PCB to peripherals.

One problem associated with such multiple placement of interconnections is that, upon assembly of the computer, the interconnections between the peripherals and the PCBs require several assembly steps to complete the interconnections. Computers systems often are mass produced and such additional assembly procedures may increase manufacturing costs.

Thus, there has been a need for a connector which can simplify computer assembly steps relating to interconnections of a PCB to peripherals. The present invention meets these needs.

SUMMARY OF THE INVENTION

The present invention includes an electrical connector for use with a Printed Circuit Board (PCB) which includes a power and signal conductive pads disposed on an edge of the PCB and a computer chassis. The electrical connector of the present invention comprises an insulative housing which includes a front side and a rear side. A slot is formed in the front side and is dimensioned to slidably receive the PCB edge. A first and second set of passages each extend through the insulative housing between the front side and the rear side. Each passage defines an opening into the slot. The electrical connector of the present invention also includes a plurality of signal conductive members each of which includes a signal contact portion. The signal conductive members are dimensioned to be positioned in the first passages such that each respective signal contact portion extends through a respective opening.

The contact portions protrude into the slot to contact respective signal conductive pads when the PCB edge is received in the slot. Similarly, a plurality of power conductive members is provided, each of which includes a power contact portion. The power conductive members are dimensioned to be positioned in the second passages such that each respective power contact portion extends through a respective opening. The contact portions protrude into the slot to contact respective power conductive pads when the PCB edge is received in the slot.

In another aspect, the electrical connector of the present invention includes an insulative housing including a front side and a rear side. A slot formed in the front side is dimensioned to slidably receive the PCB. The insulative housing includes mounting means for mounting the housing to a computer chassis.

In still another aspect of the present invention a board-edge device comprises, briefly, at least one latch member including a main body, and at least two resilient, laterally spaced fingers extending from the main body. The board-edge device further includes an insulative housing including a front side and a rear side. A board-edge extends from the front side. The insulative housing defines at least one respective latch slot which is dimensioned to slidably receive the main body of the respective latch. The distal portions of the fingers extend substantially perpendicular to the main body of the latch.

The present invention simplifies the interconnection assembly steps by providing an electrical connector for a PCB which provides both peripheral and power transmission communication exclusively through the connector. Thus, signal and power connection can be made in a single assembly step, rather than through multiple assembly steps. Further, the present invention permits mounting of a PCB electrical interconnector to a computer chassis, which aids alignment of the PCB to simplify assembly.

DETAILED DESCRIPTION OF THE PREFERRED EMBODIMENT

Figure 1:
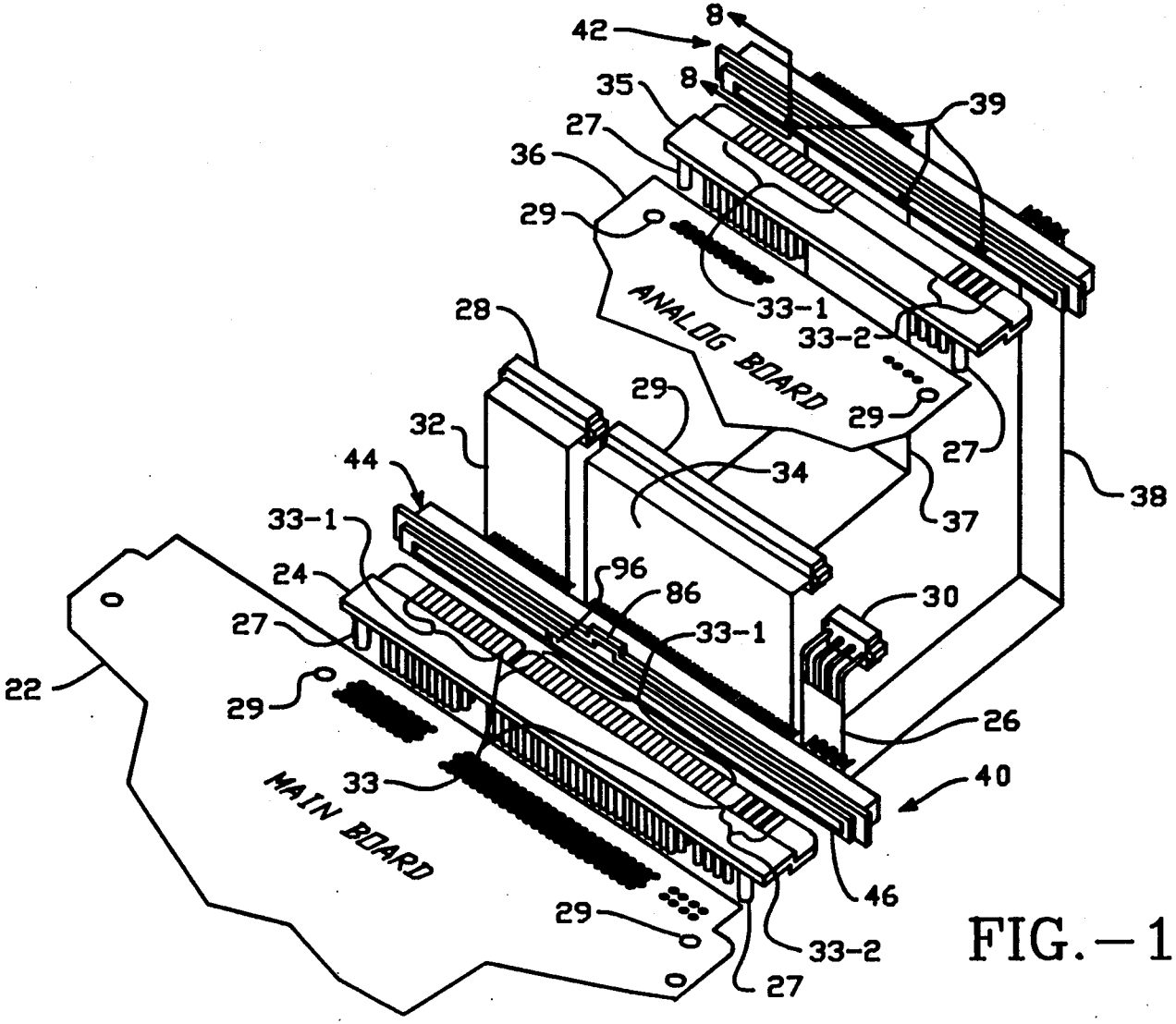
FIG. 1 is a top perspective partially exploded view of the components of a computer system employing a connector in accordance with the present invention.

Reference will now be made in detail to the preferred embodiments of the invention. While the present invention has been described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

It will be noted here that for a better understanding, like components are designated by like reference numerals throughout the various figures. Attention is directed to FIGURE where the subject electrical connector, designated 40 is illustrated. In the preferred embodiment, a Printed Circuit board (PCB) 22 includes a male board-edge connector, generally designated 24, is disposed on an edge thereof. A board-edge device provides a means of electrical communication to or from the PCB to a peripheral. Typically, a plurality of equally spaced conductive pads 33 are disposed along the board-edge device which allow electrical communication when engaged with a corresponding housing 44. It will be appreciated that the conductive pads 33, as defined herein, refer to both signal conductive pads 33-1 and power conductive pads 33-2. Alternatively, instead of a board-edge connector, a "gold-finger" conductive pad plated on the edge of the board itself can be used.

Figure 3:
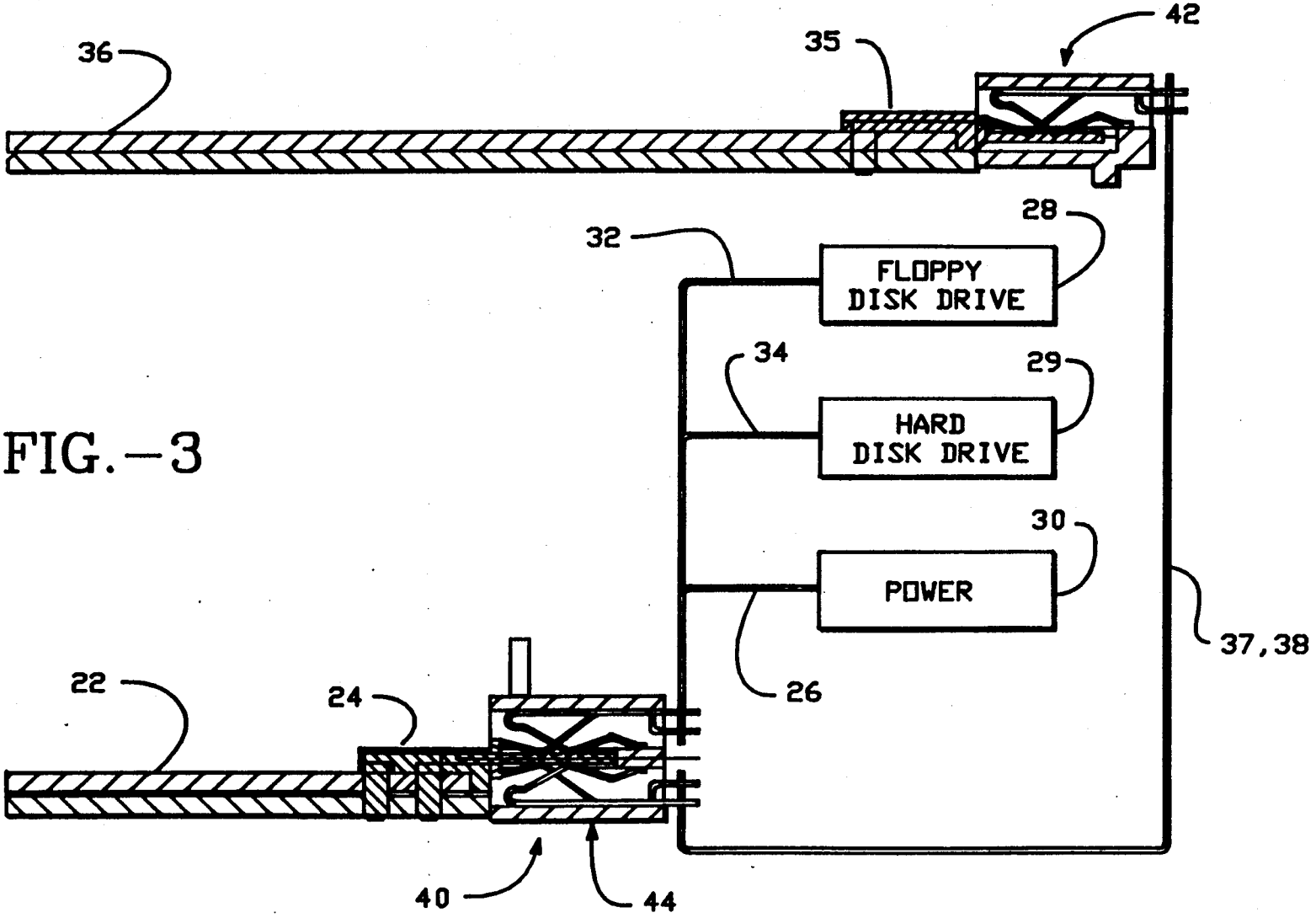
FIG. 3 is a vertical sectional view of components of a computer employing a connector in accordance with the present invention.
Figure 9:
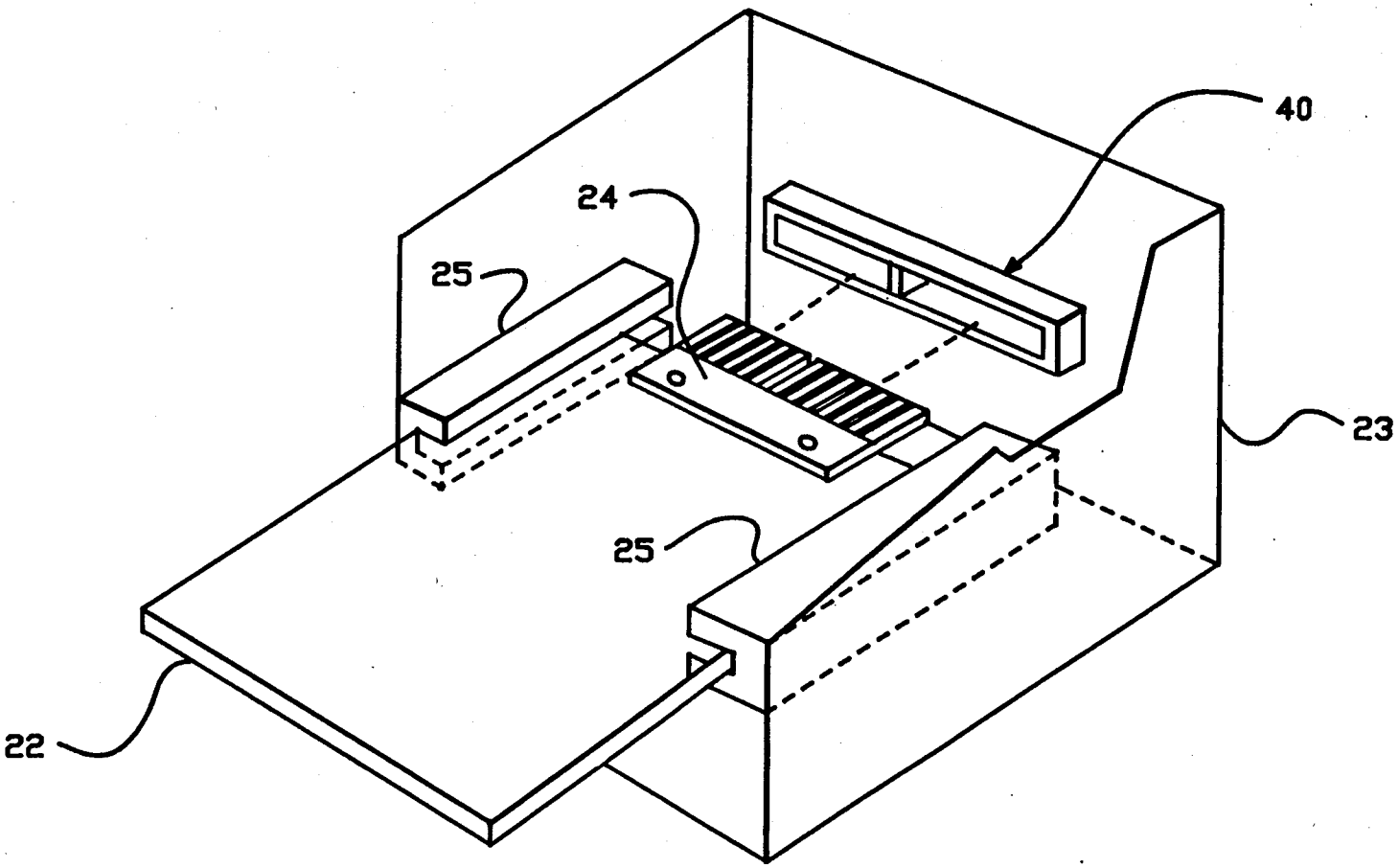
FIG. 9 is a top perspective partially exploded view of the main board housing a board-edge device slidably engaging the electrical connector of the present invention which is mounted to a computer chassis.

As will be discussed henceforth, both the interconnections between the main board 22 to the peripherals cables 32 and 34 and to the power transmission cables 26 are interfaced through the electrical connector 40. In FIG. 3, two peripherals, a floppy disk drive 28 and a hard disk drive 29, are shown electrically coupled to electrical connector 40 through ribbon cables 32 and 34. Similarly, a power source 30 coupled to transmission cables 26 is shown electrically coupled to the PCB 22 through electrical connector 40. Accordingly, assembly of a computer, electrical coupling of a main board 22 to the peripherals involves the convenient step of sliding the PCB edge 24 into the electrical connector 40, thereby resulting in simultaneously electrically connecting the floppy disk drive 28, hard disk drive 29 and power source 30 to the connector 40 through ribbon cables 32, 34 and 26. FIG. 9, further, illustrates connector 40 mounted to a computer chassis 23 and aligned with opposing board guides 25 such that the board-edge device 24 of main board 22 engages connector 40.

One advantage of the present invention is that when multiple PCBs are required, connectors 40 may be space-savingly stacked. In such circumstance, another PCB, such as the analog board 36 viewed in FIGS. 1 and 3, may be coupled to the main board 22 through ribbon cables 37 and 38, and through a second inventive electrical connector 42.

Figure 2:
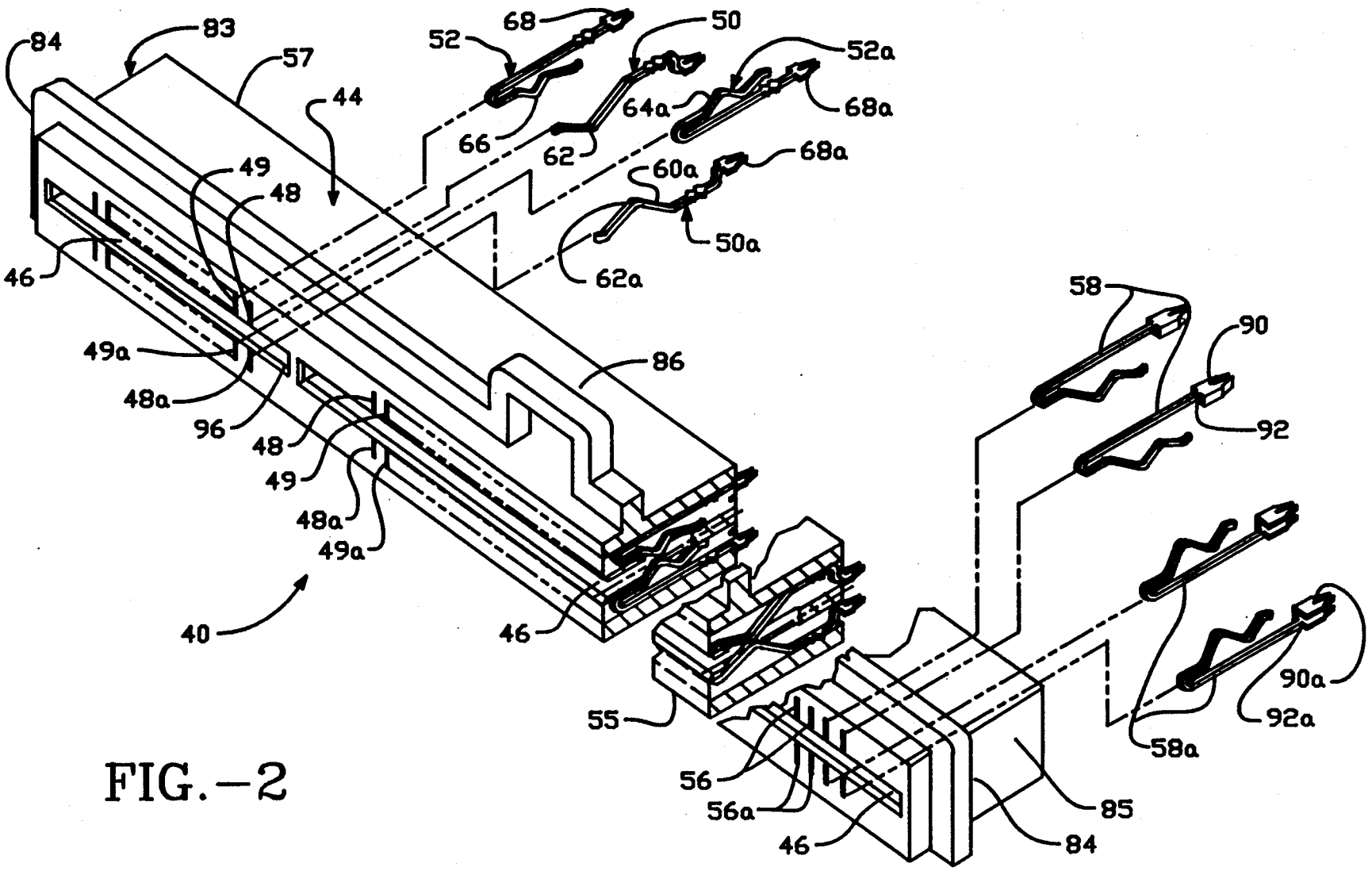
FIG. 2 is an exploded cutaway perspective top view of a presently-preferred embodiment of electrical connector assembly in accordance with the present invention.

Referring now to FIG. 2, there is shown the connector in accordance with the present invention which comprises an elongated insulative housing 44 including a front side 55 and a rear side 57 and which defines a slot 46 formed in the front side 55. Slot 46 is dimensioned to slidably receive the board-edge device 24. The depth to which slot 46 extends into housing 44 is preferably dimensioned to provide lateral stability to the board-edge 24 and, thus, interconnection stability. Housing 44, further, defines a corresponding number of first passages disposed adjacent to and above the upper longitudinal edge of slot 46. The first passages preferably comprise two types: the cantilever conductive passage 48 and the spring conductive passage 49. Both will be described in greater detail below. Briefly, both first passages 48 and 49 extend through housing 44 from the rear side 57 to the front side 55 and are dimensioned for receiving a corresponding number of respective cantilever and spring type signal conductive members 50 and 52 respectively. Signal conductive members 50 and 52 provide electrical signal communications between the PCB and the corresponding peripherals 28 and 29. This is contrasted to power conductive members 58 and **58*a* (discussed below) which are generally larger to accommodate increased current capacity requirements of power signals. Power members 58 and 58*a* are coupled to power transmission sources such as power source 30 represented in FIG. 3**.

In the preferred embodiment, complementary cantilever and spring member passages **48*a* and 49*a*, respectively, are formed on opposite sides of the slot 46. For each cantilever passage 48 formed above slot 46, there is a complementary cantilever passage 48*a* on the other side of the slot 46. Similarly, for each spring passage 48 formed above slot 46, there is a complementary spring passage 49*a* on the other side of the slot 46**.

Figure 4:
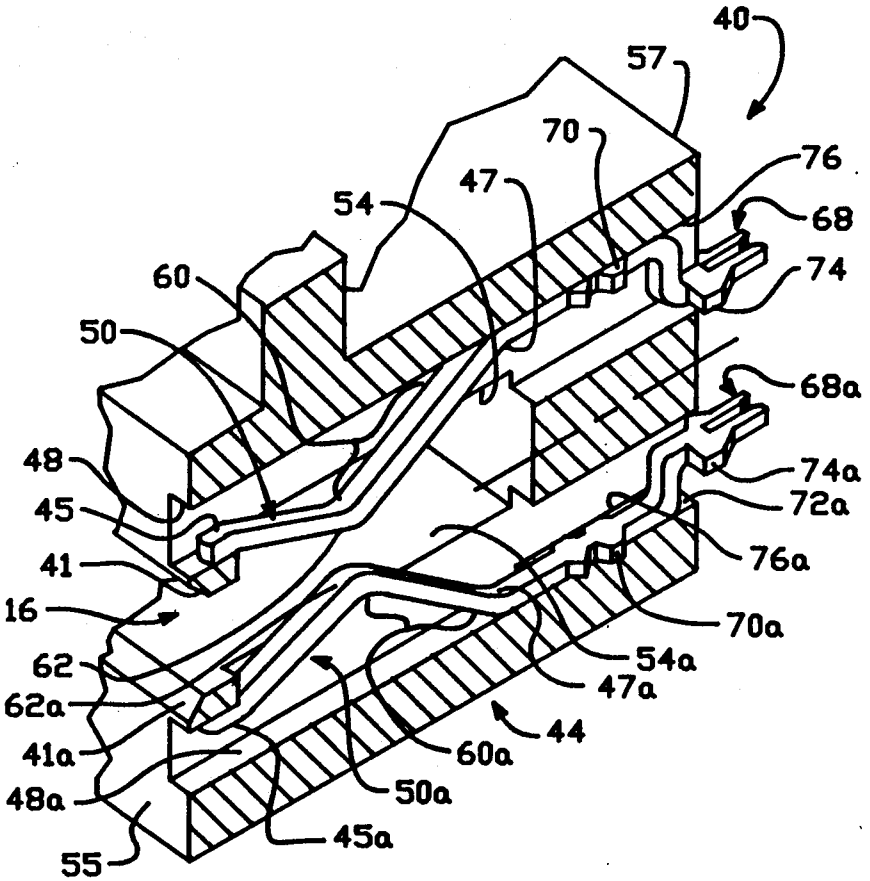
FIG. 4 is a cutaway perspective view of the connector of FIG. 2 illustrating a cantilever-type conductive member.

FIGS. 2 and 4 illustrate that the housing 44 defines a first cantilever opening 54 between each cantilever member passage 48 and the slot 46, and defines a second cantilever opening **54*a* between each cantilever passage 48*a* and the slot 46. Therefore, as will be described in greater detail below, when the cantilever conductive members 50 and 50*a* are respectively positioned in cantilever member passages 48 and 48*a*, first and second cantilever openings 54 and 54*a* allow cantilever conductive members 50 and 50*a* to electrically communicate therethrough to the slot 46**.

Figure 5:
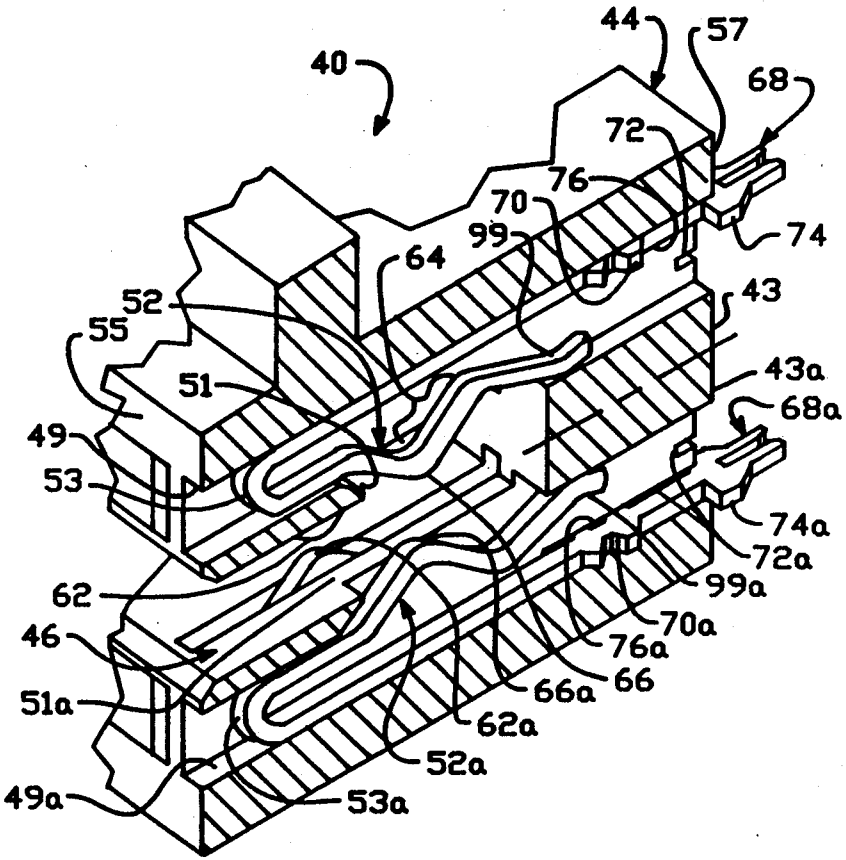
FIG. 5 is a cutaway perspective view of the connector of FIG. 2 illustrating a spring-type conductive member.

Similarly, as can be seen in FIGS. 2 and 5, housing 44 further defines a first spring opening 51 between each spring member passage 49 and the slot 46, and defines a second spring opening **51*a* between each spring passage 49*a* and the slot 46. Thus, when the spring conductive members 52 and 52*a* are respectively positioned in spring member passages 49 and 49*a*, first and second spring openings 54 and 54*a* allow members 52 and 52*a* to electrically communicate therethrough to the slot 46**.

Upon insertion of board-edge device 24 into slot 46, each signal cantilever and spring conductive members 50, **50*a* and 52, 52*a* electrically engages the corresponding conductive pads 33 of board-edge device 24. Electrical communication is then provided by cantilever and spring conductive members 50 and 52 extending through insulative housing 44** which, in turn, provides communication to the peripherals or completes the logic circuitry.

A first signal conductive member represented in FIG. 4 is a cantilever-type conductive members 50 and **50*a* shown in a non-engaged position. Member 50 positioned in cantilever member passage 48 includes a cantilever contact portion 60 having an apex 62. Cantilever apex 62 represents the area where electrical coupling with corresponding conductive pads 33 occurs. Cantilever contact portion 60 extends through the first opening 54 provided by the cantilever member passage 48 and protrudes into the slot 46 to provide electrical contact upon engagement of the card-edge conductive finger 33**.

Similarly positioned in complementary cantilever passage 48a, as viewed in FIG. 4, is an oppositely facing cantilever conductive member 50a having a like apex point 62a protruding through complementary second opening 54a. Apex point 62a directly opposes apex 62 when contacting the conductive pad 33. Such configuration evenly distributes contact pressure along the board-edge device 24 by providing an equal, but opposite, force on pads 33. Ultimately, this provides a better electrical contact between apex 62 and 62a, and conductive pads 33.

As cantilever members 50 and 50a are inserted into cantilever member passages 48 and 48a, the distal front ends 45 and 45a opposingly engage lower support ledges 41 and 41a positioned at the front of cantilever member passages 48 and 48a. These ledges provide support for contact portions 60 and 60a to oppose the tendency of elbows 47 and 47a to rotate causing apexes 62 and 62a to extend into the slot 46. Therefore, when members 50 and 50a resiliently engage the conductive pads 33 of board-edge device 24, respective contact portions 60 and 60a cantilever about elbows 47 and 47a.

A second type of signal conductive member is the spring-type conductive members 52 and 52a shown in FIG. 5. The spring-type members 52 and 52a include spring contact portions 64 and 64a having apexes 66 and 66a. Spring contact portions 64 and 64a resiliently displace about U-shaped spring portions 53 and 53a positioned proximate the front of spring member passages 49 and 49a. Moreover, the distal ends 99 and 99a of spring members 52 and 52a, respectively, are supported at the rear of spring member passages 49 and 49a by rear ledges 43 and 43a. This configuration results in a contact pressure of apexes 66 and 66a against conductive pads 33 substantially equal to the cantilever-type contact pressure of apexes 62 and 62a against pads 33. This is important because, as will be discussed henceforth, spring-type apexes 66 and 66a are positioned deeper into slot 46 than are cantilever-type apexes 62 and 62a.

Figure 8:
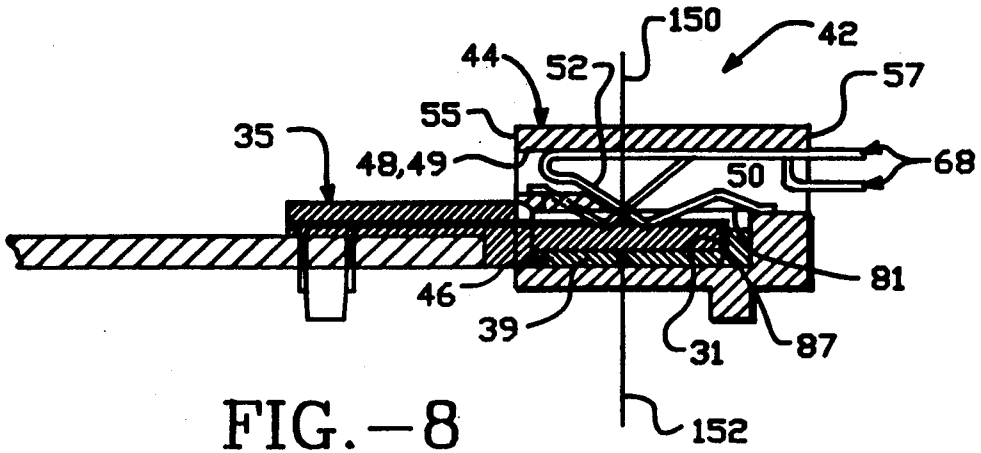
FIG. 8 is a vertical sectional view, taken substantially along the plane of line 8—8 in FIG. 1, of the electrical connector in accordance with the presentinvention engaged with the single sided board-edge device of the type shown in FIG. 7.
Figure 6:
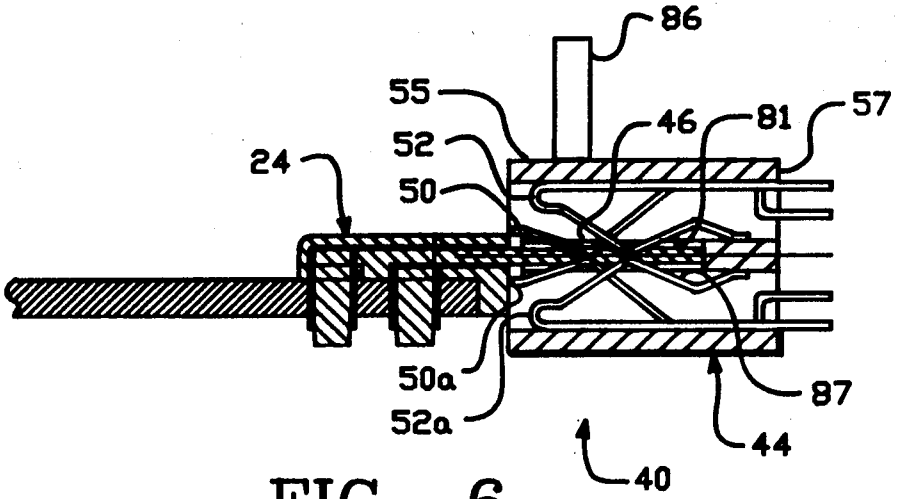
FIG. 6 is a vertical sectional view of the connector of FIG. 2 engaged with a conventional dual sided board-edge having conductive fingers.

As just mentioned, in the preferred embodiment, illustrated in FIGS. 5, 6 and 8, the cantilever apex points 62 and 62a, and the spring apex points 66 and 66a are positioned at two different depths along slot 46 to reduce the insertion force required to insert the board-edge device 24 into slot 46. Collectively, upon electrical engagement with conductive pads 33, each opposing spring-type apex points 66 and 66a will contact the conductive pads 33 at a position deeper into slot than the collective contacts of cantilever-type apex points 62 and 62a with conductive pads 33.

Pairs of cantilever member passages 48 and 48a are dimensioned to receive pairs of cantilever conductive members 50 and 50a. Pairs of spring member passages 49 and 49a are dimensioned to receive pairs of spring conductive members 52 and 52a. The cantilever member passages 48 and 48a, and the spring member passages 49 and 49a alternate. There is a pair of spring member passages 49 and 49a between each adjacent pair of cantilever member passages 48 and 48a; and there is a pair of cantilever member passages 48 and 48a between each adjacent pair of spring member passages 49 and 49a.

Both cantilever and spring conductive members 50 and 50a, and 52 and 52a each include an insulation displacement contact (IDC) 68 and 68a disposed at the rear distal ends of members 50 and 50a, and 52 and 52a. The IDCs 68 and 68a are well known connections which provide a simple means for coupling the peripheral ribbon cables 32 and 34 to the conductive members 50 and 50a, and 52 and 52a. Typically, IDCs include a sharp wedge means dimensioned to puncture a ribbon coating on ribbon cables 32 and 34, and securably contact respective cables. However, other connectors can be used without departing from the present invention. Both spring and cantilever-type conductive members include shoulder portions 74 and 74a integrate with IDCs 68 and 68a, respectively. Retention barbs 70 and 70a are disposed proximate each respective IDC 68 and 68a and conductive members 50 and 50a, and 52 and 52a. As best be viewed in FIGS. 4 and 5, once conductive members 50 and 52 are inserted into respective passages, IDCs 68 and 68a are positioned at the rear side 57 of insulative housing 44.

Moreover, insulative housing 44 further defines grooves 72 and 72a disposed adjacent each first passages 48, 48a and 49, 49a at the rear side 57 of housing 44. Grooves 72 and 72a are dimensioned to receive shoulder portions 74 and 74a of IDCs 68 and 68a, respectively. Such engagement of shoulders 74 and 74a with grooves 72 and 72a prevent twisting of IDCs 68 and 68a when connection to ribbon connectors 32 and 34 is made.

Corresponding retention barb recesses 76 and 76a are provided in the first passages 48, 48a and 49, 49a, respectively, which engage with retention barbs 70 and 70a. These allow insertion of signal conductive members 50 and 50a, and 52 and 52a in the corresponding passages. Retention barbs 70 and 70a retain the conductive members in first passages 48, 48a and 49, 49a and, thus, prevent easy withdrawal.

In accordance with the present invention, a complementary pair of power conductive members 58 and 58a are used to transmit power signals through insulation housing 44. It will be appreciated that power conductive members 58 and 58a are preferably structurally identical to signal spring conductive members 52 and 52a but are larger to accommodate the increased current capacity requirements of power signals. It will be appreciated that power members 58 and 58a could just as easily resemble cantilever conductive members 50 and 50a without departing from the true spirit of the invention. The individual power cables 26 are similarly larger which require a more stable connection to members 58 and 58a. To achieve better stability, respective IDCs 90 and 90a, disposed at the rear distal ends of members 58 and 58a, include two-wedge contacts as shown in FIG. 2. Doubling the wedge contacts provides a more stable connection to power transmission lines 26. Moreover, power conductive members 58 and 58a similarly include retention barbs 92 and 92a.

A second set of power passages 56 and 56a, similarly are disposed adjacent slot 46 similar to first passages 48, 48a and 49, 49a as can be seen in FIG. 3. Second passages 56 and 56a are dimensioned to accept corresponding power spring conductive members 58 member 58a which are also deployed in a manner similar to signal spring conductive members 52 and 52a. Similarly, corresponding respective barb recesses (not shown) are provided in second passages 56 and 56a which are dimensioned to engage retention bars 92 and 92a. A corresponding number of first and second power openings (not shown) allow power conductive members 52 and 52a to electrically communicate therethrough into slot 46.

As shown in FIG. 3, power spring conductive members 58 and 58a together with their respective second passages 56 and 56a are preferably grouped together in housing 44 and provide the power transmissions to the PCB. Grouping is not necessary to the novelty of the present invention. However, it will be appreciated that adjacently disposed second passages 56 and 56a are spaced-apart by a distance greater than adjacently disposed first passages 48, 48a and 49, 49a, as shown in FIG. 2. The signal conductive members 50, 50a and 52, 52a can be densely arranged to reduce the layout dimension or increase the number of speed the transmission. However, adjacent passages of the second set of passages 56 and 56a are spaced much farther apart so that adjacently disposed power conductive members 58 and 58a can be better insulated from one another. Because of the current and voltage requirements needed by "Mother" Board 22, unlike "Daughter" Board 36, the greater spacing and insulation between adjacent passages 58 and 58a forms a good heat sink. This allows better heat radiation because the amount of heat resulting from power conductive members 58 and 58a, even though the resistance is less, is much greater than that from signal conductive members 50, 50a and 52, 52a.

Therefore, in accordance with the present invention, the electrical connector assembly 40 houses both the signal interconnections and the power transmission interconnections to the PCBs.

Preferably, the connector 44 of the present invention is adapted to receive the dual-sided board-edge device 24 including conductive pads 33 disposed on two surfaces of board-edge 24. Accordingly, slot 46 includes an inner first wall 81 and an opposed inner second wall 87, as shown in FIG. 6, formed to accommodate the dual-sided board-edge device 24. Thus, the first signal cantilever and first spring conductive members 50 and 52, and first power spring conductive members 58 electrically communicate with slot 46 through corresponding first cantilever openings 54, first spring openings 51 and first power openings (described above) in the inner first wall 81, while the second signal cantilever and second spring conductive members 50a and 52a, and second power spring conductive members 58a electrically communicate with slot 46 through corresponding second cantilever openings 54a, second spring openings 51a and second power openings (described above) in the inner second wall 87. This configuration, as shown in FIG. 6 provides a uniform, equal and opposite engaging force on both surfaces of board-edge device 24.

Figure 7:
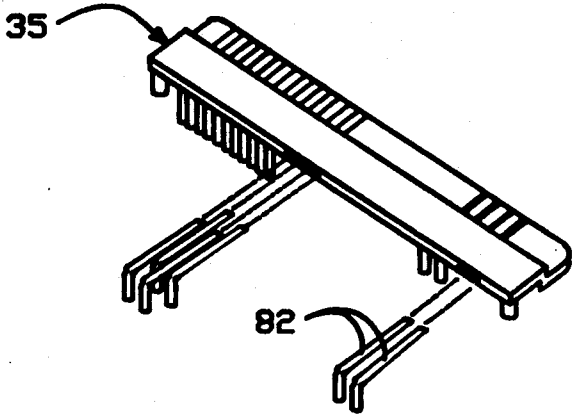
FIG. 7 is an exploded top perspective view of a conventional single sided board-edge connector employing band type conductive fingers.

Alternately, the connector of the present invention can be easily adapted to work in conjunction with a single-sided board-edge device, generally designated 35, as viewed in FIG. 7. The single-sided board-edge device 35 employs band-type conductive members 82 which are disposed on only one surface the board-edge. Thus, in an alternative embodiment, shown in FIGS. 1, 3 and 8, the corresponding electrical connector 42 only provides a single row of first and second passages 48 and 56, respectively, disposed on only one side of slot 46, namely the inner first 81 of the slot 46.

As best viewed in FIGS. 1 and 8, ridges 39 upstand into slot 46 from the inner second wall 87. Ridges 39 substantially extend from a front side 55 of slot 46 to a rear side of slot 46. Accordingly, when single- sided board-edge device 35 is inserted into slot 46, as shown in FIG. 8, the respective spring and cantilever conductive members 50 and 52, and power conductive members 58 exert a first force in a direction indicated by arrow 150 on the board-edge device 35. Similarly, ridges 39 exert a compensating second force in the direction indicated by arrow 152 on the opposing surface of the board-edge device 35. The second force 152 directly opposes and compensates for the first force 150. Ridges 39 provide support to the bottom surface of board-edge device 35, in the direction of second force 152, to assure that spring and cantilever conductive members 52 and 50 snugly engage conductive pads 33.

Moreover, a backstop 31 formed proximate the rear of ridge 39 prevents board-edge device 35 from being inserted too deeply into slot 46.

As illustrated in FIG. 9 and as will be described in greater detail below, the electrical connector 40 is mounted directly to the computer chassis 23. Thus, alignment means are provided on housing 44. The alignment means are preferably provided as flanges 84 and are dimensioned to fit into corresponding alignment posts (not shown) installed on the computer chassis 23. These flanges 84 are preferably positioned at the opposite ends 83 and 85 of insulative housing 44. Flanges 84 are formed to provide alignment of connector 40 with the computer chassis 23.

A mounting means, designated 86, is provided on housing 44 for removably mounting connector 40 to the chassis 23. This mounting means is preferably a mounting member which includes a slot 86 dimensioned to receive a corresponding mounting peg (not shown) installed on the computer chassis 23. When connector 40 is positioned on the computer chassis 23, the mounting peg is engages slot 86 to removably lock the connector 40 to the chassis 23. Mounting slot 86 is preferably centrally positioned on the longitudinal top side of housing 44. In the alternative, mounting slot could easily be positioned on the bottom side without departing from the true spirit of the present invention.

As electrical connector alignment flanges 84 engage the corresponding posts installed on the chassis 23, mounting slot 86 engages the corresponding mounting peg which removably mounts connector 40 to the chassis. This rigidly fixes connector 40 to the chassis 23 which provides a stable means for PCB 22 to interconnect with the peripherals 28 and 29, and the power source 30. Moreover, when connection 40 is aligned and mounted to the chassis, the PCB 22 can be simply slid, using guides 25, into connector 40 without requiring any additional attachment to the chassis 23, as viewed in FIG. 9.

PCB alignment posts 96 are formed within slot 46 as can be seen in FIGS. 1 and 3. Alignment posts 96 provide a means to properly align the conductive pads 33 of board-edge device 24 with the corresponding conductive members in connector 40 to ensure that the board-edge connector 24 will be properly inserted into the electrical connector 40.

Figure 10:
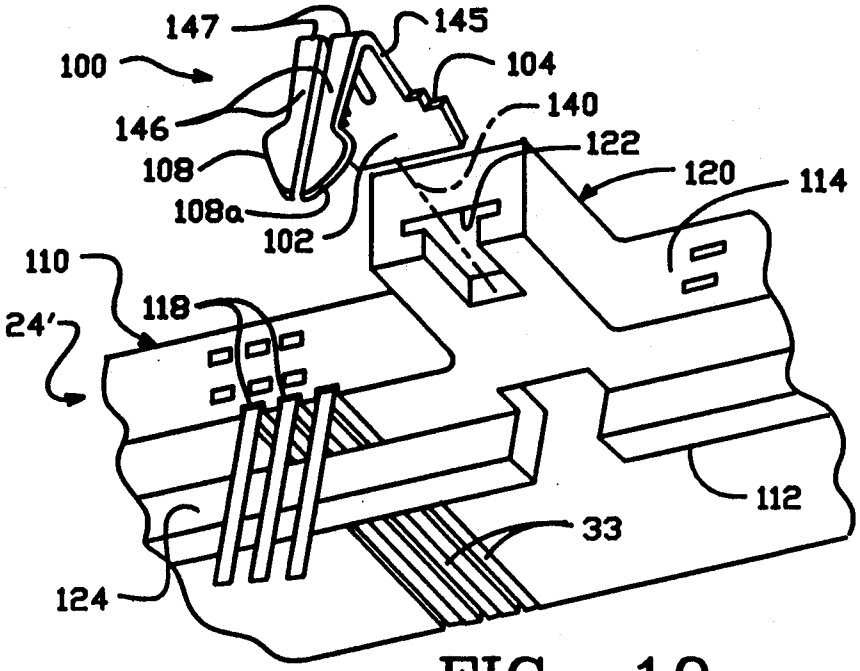
FIG. 10 is a bottom cutaway perspective partially exploded view of a removable board-edge device latch engaging a board-edge connector in accordance with the present invention.

Referring now to FIG. 10, there is shown a resilient latch, generally designated 100, in accordance with the present invention. As will be discussed henceforth, latches 100 provide an alternative removable means to attach a board-edge device 24' to the PCB 22. The first embodiment board-edges provide permanent upstanding posts 27, as shown in FIG. 1, which mount and align board-edge device 24 to PCB 22. In an alternative embodiment in accordance with another aspect of the present invention, rather than providing permanent posts 27 which correspond to PCB apertures 29, removable latches 100 are installed in board-edge device 24'. The use of a latch greatly aids separation of the board-edge device 24' from the PCB 22 or 36 because latches 100 can be removed from apertures 29.

Figure 11:
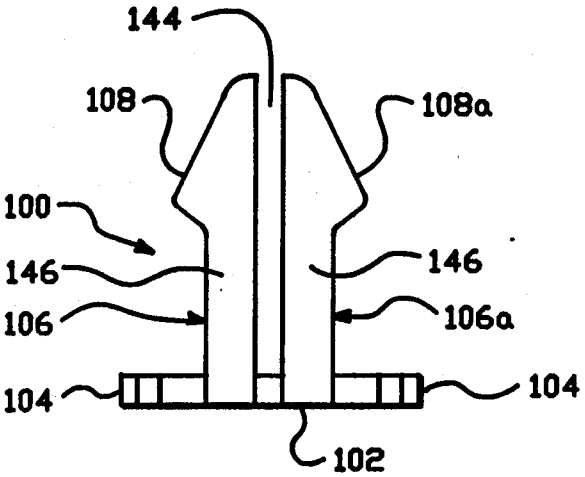
FIG. 11 is a front elevation view of the removable board-edge latch in accordance with the present invention.
Figure 13:
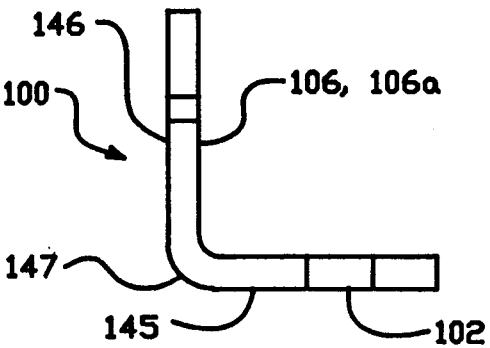
FIG. 13 is a side view of the latch of FIG. 11.
Figure 12:
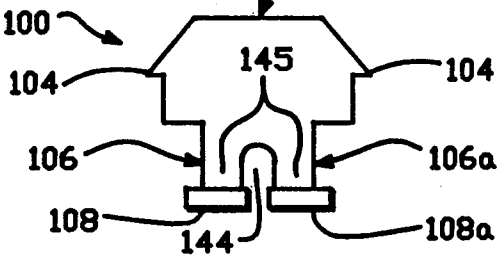
FIG. 12 is a top view of the latch of FIG. 11.

Latch 100, as viewed in FIGS. 11-13, comprises a substantially planar main body 102 which includes two retention barbs 104 disposed on opposite sides of the main body 102. Barbs 104 retain latch 100 in a receiving latch slot 122 which will be discussed below. Extending outwardly from main body 102 are two resilient, substantially parallel, laterally spaced fingers 106 and 106*a*. The fingers 106 and 106*a* define a rectangular space 144 therebetween.

In each respective finger 106 and 106*a*, a first respective portion 145 extends substantially parallel to the main body 102. A second respective portion 146 extends perpendicular to main body, as shown in FIGS. 11-13. The respective first and second portions of fingers 106 and 106*a* are joined at bend 147. Thus, as can be seen in FIG. 13, latch 100 is substantially L-shaped.

The distal ends of respective fingers 106 and 106*a* each are inclined outwardly so as to form respective prongs 108 and 108*a*.

In accordance with the present invention, board-edge device 24' further comprises an elongated, insulative board-edge, generally designated 110, which includes a front side 112 and a rear side 114. As best viewed in FIG. 10, board-edge 110 defines a plurality of conductive pad slots 118 extending from the rear side 114 to the front side 112. Each slot 118 is dimensioned to receive conductive pads 33. Thus, in correspondance with the board-edge connector 44 of the present invention, the board-edge device 24' of the present invention houses both the signal conductive pads 33-1 and power the conductive pads 33-2 of FIG. 1.

At least one standoff 120 extends rearward from the rear side 114 of housing 110 and defines a latch slot 122. However, preferably, two standoffs 120 extend from the rear side 114 of housing 110 to provide mounting stability to the PCB 22. Thus, as shown in FIG. 1, each latch 100 would extend through respective apertures 29.

Referring back to FIG. 10, latch slot 122 is dimensioned to receive the planar main body 102 of latch 100. Thus, latch 100 is aligned with and pushed into slot 122 in the direction of arrow 140 wherein retention barbs 104 slidably engage the inside walls of the slot 122 to retain latch 100 therein.

Once latch 100 is securely retained in slot 122, the board-edge device 24, may be mounted to a PCB edge. A PCB edge (not shown) is positioned to abut a mounting flange 124 such that prongs 108 and 108*a* align respective apertures (not shown) extending through PCB 22. In a relaxed state, the distance between the outermost edges of prongs 108 and 108*a* are greater than the diameter of the corresponding respective aperture. Thus, as each respective prong 108 and 108*a* of respective lateral fingers 106 and 106*a* engages the edges of corresponding aperture, upon insertion, the prongs 108 and 108*a* are compressed inward toward each other until respective prongs 108 and 108*a* clear the aperture 29 edges. Subsequently, respective resilient fingers 106 and 106*a* resist the compressive forces and are urged outward after passing through the aperture, retaining latch 100 in respective aperture 29 by the edges of prongs 108 and 108*a*, and hence board-edge 24 against PCB 22.

While the invention has been described in connection with what is presently considered to be the most practical and preferred embodiments, it is to be understood that the invention is not limited to the disclosed embodiment but, on the contrary, is intended to cover various modifications and equivalent arrangements included within the spirit and scope of the appended claims.

Therefore, persons of ordinary skill in this field are to understand that all such equivalent structures are to be included within the scope of the following claims:

What is claimed is:

1. An electrical connector assembly for releasable mounting of a Main Printed Circuit Board (PCB) to a computer chassis, said PCB including a plurality of power conductive pads and a plurality of signal conductive pads with all of said power conductive pads and said signal conductive pads on the PCB being disposed together in a side-by-side array along an edge of the PCB, the connector assembly comprising:

an insulative unitary housing including a front side and a rear side, said unitary housing being formed with a slot in the front side dimensioned to a slidably receive the PCB edge, said unitary housing further defining a first set of passages disposed at a first portion of said housing and a second set of passages disposed at a separate second portion of said housing, each passage of said first and second set of passages extending between the front side and the rear side of said housing and each including an opening into said slot, and each adjacent passage of said second set of passages being spaced apart by a distance greater than each adjacent passage of said first set of passages;

a plurality of signal conductive members each including a signal contact portion, said signal conductive members being positioned in said first passages and extending through each respective opening to protrude into said slot to contact respective signal conductive pads when the PCB edge is received in said slot, said signal conductive members each including a signal Insulation Displacement Contact (IDS) extending outwardly of said unitary housing, and said signal IDCs being grouped for connection to peripheral apparatus through ribbon cables; and a plurality of power conductive members each being of substantially similar shape but larger in transverse cross-sectional area than each said signal conductive members and each including a power contact portion, said power conductive members being positioned in said second passages and extending through each respective opening to protrude into said slot to contact respective power conductive pads when the PCB edge is received in said slot, said power conductive members each including a power Insulation Displacement Contact (IDC) extending outwardly of said unitary housing, and said power IDCs being grouped for connection to a plurality of power sources through ribbon cables.

2. The electrical connector as defined in claim 1 further including:

board guide means mounted to the computer chassis for guiding the PCB edge into engagement with said slot, said board guide means defining channels formed and dimensioned to receive opposing side edges of the PCB.

3. The electrical connector assembly as defined in claim 2 wherein, said insulative housing includes flanges extending outwardly from side portions of said unitary housing for aligning said housing with said chassis.

4. The electrical connector assembly as defined in claim 2 wherein, said insulative housing includes a mounting slot for mounting said housing to said chassis.

5. The electrical connector assembly as defined in claim 2 wherein, said housing defines respective grooves disposed adjacent each said first passage and each said second passage, said grooves being dimensioned to receive a portion of each of said signal and power IDCs.

6. The connector assembly as defined in claim 2 wherein, said signal and power conductive members each respectively include at least one barb; and each said first passage and each said second passage include respective recesses dimensioned to engage said respective barbs.

7. The connector assembly as defined in claim 2 wherein, said first passages defining a plurality of spring member passages;

said first passages defining a plurality of cantilever member passages;

said signal conductive members include a plurality of corresponding spring conductive members including corresponding spring contact portions, said spring contact portions including first apexes positioned at a first slot depth relative to said slot; and said signal conductive members include a plurality of corresponding cantilever conductive members including corresponding cantilever contact portions, said cantilever contact portions including second apexes positioned at a second slot depth relative to said slot.

8. The connector assembly as defined in claim 7 wherein, said spring member passages and said cantilever member passages are arranged in an alternate side-by-side manner.

9. The connector assembly as defined in claim 2 wherein, said slot is defined by an inner first wall and an opposed facing inner second wall;

said first passages and said second passages communicate with said slot through said respective openings in said first wall; and said second wall includes at least one ridge upstanding between said front side and said rear side.

* * * * *

UNITED STATES PATENT AND TRADEMARK OFFICE

CERTIFICATE OF CORRECTION

PATENT NO. : 5,190,480

DATED : March 2, 1993

INVENTOR(S) : Lee-Ming Cheng, et al.

It is certified that error appears in the above-identified patent and that said Letters Patent is hereby corrected as shown below:

Column 2, FIGURE 8, line 52, delete "presentinvention" and insert ---present invention---.

Column 3, line 16, after "FIGURE" insert ---1---.

Column 5, line 49, insert ---36--- before "than".

Column 10, line 18, Claim 1: after "to" and before "slid-" delete "a".

Column 10, line 38, Claim 1: delete "IDS" and insert ---IDC---.

Signed and Sealed this

Twenty-third Day of November, 1993

*Attest:*

*Attesting Officer*

Bruce Lehman

BRUCE LEHMAN

*Commissioner of Patents and Trademarks*